US005586631A

United States Patent [19]

Benthin

[11] Patent Number: 5,586,631

[45] Date of Patent: Dec. 24, 1996

[54] WINDOW SHADE

[75] Inventor: Siegfried Benthin, Bremerhaven, Germany

[73] Assignee: Benthin Aktiengesellschaft, Bremerhaven, Germany

[21] Appl. No.: 363,513

[22] Filed: Dec. 22, 1994

[30] Foreign Application Priority Data

Dec. 24, 1993 [DE] Germany ..... 43 44 627.2

[51] Int. Cl.[6] ..... E06B 9/84

[52] U.S. Cl. ..... 192/8 R; 160/297

[58] Field of Search ..... 192/8 R; 188/82.84; 160/297

[56] References Cited

U.S. PATENT DOCUMENTS

| | | | |
|---|---|---|---|
| 2,670,824 | 3/1954 | Banker | 192/8 R |
| 2,787,353 | 4/1957 | Spraragen | 192/8 R |
| 2,812,044 | 11/1957 | Cole | 192/8 R |
| 3,232,124 | 2/1966 | Weber | 192/8 R X |
| 4,372,432 | 2/1983 | Waine et al. . | |
| 4,466,475 | 8/1984 | Saito et al. | 160/297 |
| 5,248,017 | 9/1993 | Schwarzbich | 192/8 R |
| 5,392,887 | 2/1995 | Nisenson | 192/8 R |
| 5,460,253 | 10/1995 | Ritter et al. | 192/8 R |

FOREIGN PATENT DOCUMENTS

| | | | |
|---|---|---|---|
| 0229681 | 7/1987 | European Pat. Off. | 160/297 |
| 2339170 | 11/1975 | Germany . | |

*Primary Examiner*—Rodney H. Bonck
*Attorney, Agent, or Firm*—McGlew and Tuttle, P.C.

[57] ABSTRACT

A window shade, in which a winding shaft, which is rotatably mounted with its ends on stationary pivot pins, can be coupled with a drive member at one of its ends. At least one rolling body is arranged in a recess, which is wedge-shaped in the circumferential direction, between an inner jacket surface of a pivot sleeve projection, which is rigidly mounted on the pivot pin, and an outer jacket surface of a shaft sleeve projection, which is rigidly mounted on the winding shaft. The rolling body acts as a locking member and is clamped in the wedge-shaped recess and can be released from the clamped position by an opening element movable by the drive member in the direction of rotation.

12 Claims, 1 Drawing Sheet

WINDOW SHADE

FIELD OF THE INVENTION

The present invention pertains to a window shade in which a winding shaft, which is rotatably mounted at its ends on stationary pivot pins, can be coupled with a drive member at least at one end, and has at least one locking member, which interlocks the winding shaft loaded in the roll-off direction of the window shade with the pivot pin.

BACKGROUND OF THE INVENTION

German Auslegeschrift No. DE-AS 23,39,170 discloses such a window shade, in which a winding shaft, which is rotatably mounted at its ends on stationary pivot pins, can be coupled at least at one of its ends with a drive member and has at least one rolling body, which acts as a locking member and interlocks the winding shaft loaded in the roll-off direction of the shade with the pivot pin.

In another prior-art device according to U.S. Pat. No. 4,372,432, the pivot pin at both ends of the winding shaft can be nonrotatably fastened to a wall, ceiling or the like with a bracket, wherein the bracket engages a slot arranged on the outer front surface of the pivot pin.

Such a shade can be locked in various positions. The locking member consists of a coil spring, which acts in the manner of a sliding clutch and fixes the shade by frictional connection with a sleeve.

In addition, a great variety of so-called spring-type window shades have been known, which have locking members consisting of catches, which are arranged radially movably in relation to the window shade axis and cooperate with stationary abutments on the winding shaft. Free movement is achieved due to the radially movable linkage of the catches during rapid rotation of the window shade shaft, so that the catches come into contact with the abutments under their own weight only during slow rotation of the window shade shaft and bring about blocking between the window shade shaft and the stationary pin.

SUMMARY AND OBJECTS OF THE INVENTION

An object of the present invention is to design a window shade that can be operated with low noise and that runs smoothly without spring elements with a reliably operating mechanism, which makes it possible to lock the window shade by its own weight in any desired position.

According to the invention, a window shade is provided in which a winding shaft, which is rotatably mounted at its ends on stationary pivot pins, can be coupled with a drive member at least at one end, and has at least one locking member, which interlocks the winding shaft loaded in the roll-off direction of the window shade with the pivot pin. At least one rolling body, which acts as a locking member, is clamped in a recess and can be released from the clamped position by means of an opening element. The opening element is movable by the drive member in the direction of rotation and is arranged in the recess. The opening element is wedge-shaped in the circumferential direction, between an inner jacket surface of a sleeve projection that is rigidly mounted on the pivot pin and an outer jacket surface of a sleeve projection, that is rigidly mounted on the winding shaft.

The parts of the mechanism for the actuation and for the blocking of the window shade may be made of metal or a suitable plastic. The window shade is blocked in a continuously adjustable manner at any desired height position by positive locking without spring elements. This locking is brought about automatically by the weight of the window shade and is reliable in operation. Unlocking can be brought about only by actuating the drive member.

The sleeve projection, which is stationary in relation to the winding shaft, is rotatably mounted on the pivot pin and has an outer jacket surface extending eccentrically in relation to the central axis in the area of the recess with the rolling bodies located in it. A plurality of recesses are preferably provided in the circumferential direction between the two sleeve projections, and the rolling bodies are arranged in them in pairs. The opening elements extend in the axial direction between two rolling bodies. These opening elements are arranged in pairs and are provided on a ring arranged rotatably on the pivot pin. This ring is coupled with the drive member by a planet gear drive. The planet gears are arranged in recesses of the pivot pin and engage the inner teeth of the drive member at one end and engage the internal teeth of the ring, which connects the opening elements to one another, with the other end.

Means for limiting the angle of rotation of the opening elements are provided. Each opening element has, on the inside, an axially extending coil spring. Each opening element engages with this coil spring a broader groove on the circumference of the sleeve projection, which is rigidly mounted on the winding shaft. The sleeve projection, which is stationary in relation to the winding shaft, is provided at one end within an outer sleeve. The outer sleeve can be nonrotatably inserted into the open tubular end of a winding shaft, and is rotatably mounted on the pivot pin.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENTS

Figure 1:
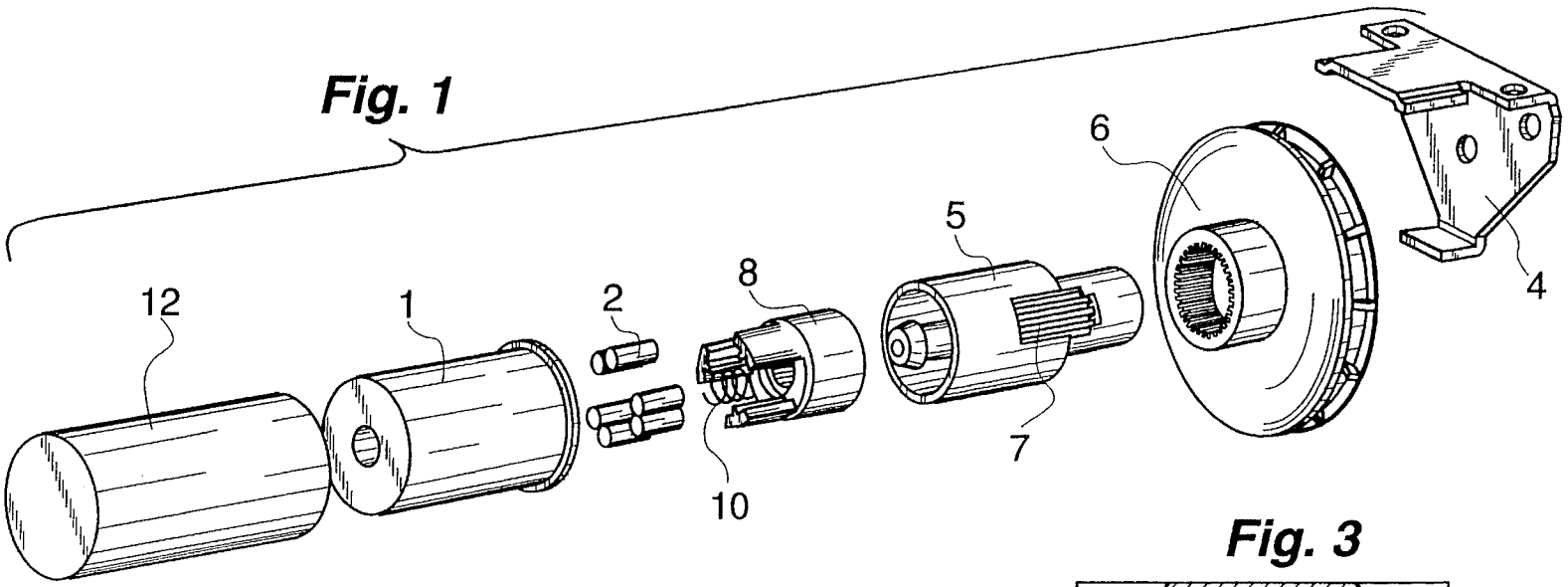
FIG. 1 is an exploded view of the elements of the actuating mechanism according to the invention.
Figure 3:
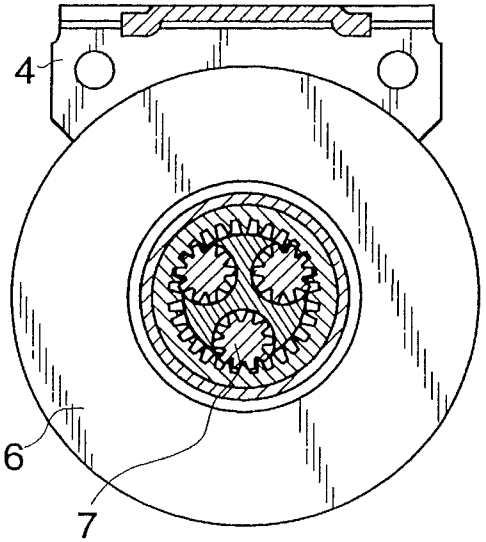
FIG. 3 is a sectional view taken along line III—III in FIG. 2.
Figure 2:
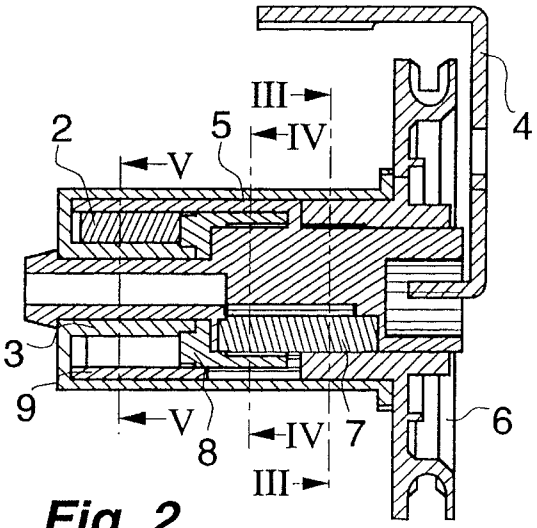
FIG. 2 is a sectional view based on an axial plane through the drive-side end of the window shade.
Figure 4:
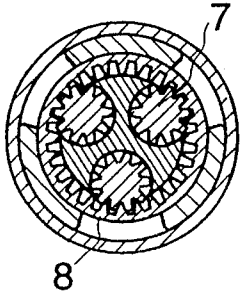
FIG. 4 is a sectional view taken along line IV—IV in FIG. 2.
Figure 5:
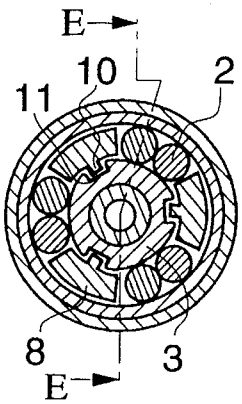
FIG. 5 is a sectional view taken along line V—V in FIG. 2.

Referring to the drawings in particular, the invention comprises a pivot pin 5 which can be fastened to a ceiling, a wall or the like by means of a bracket 4. The wall bracket 4 has a rectangular profile and engages a slot on the front surface of the pivot pin 5 and thus secures the pivot pin 5 against rotation. An outer sleeve 1 is rotatably mounted on a cylindrical jacket surface of the pivot pin 5. In addition, a drive member 6, which can be rotated, e.g., by a bead chain or the like, is rotatably mounted on a cylindrical jacket surface of the pivot pin 5. At the end opposite the drive member 6, the outer sleeve 1 is provided with a shaft sleeve projection 3 (see FIG. 2), which is arranged within a pot-shaped bottom of the outer sleeve 1 and extends into a pivot sleeve projection 9 of the pivot pin 5. Rolling bodies 2, which act as locking members, are arranged in pairs in a plurality of recesses between the outer circumference of the sleeve projection 3 and the inner circumference of the sleeve projection 9. In the area of the recesses, in which the rolling bodies 2 are arranged in pairs, the outer jacket surface of the sleeve projection 3 is designed eccentrically to the central axis of the pivot body 5, so that a distance that is smaller than the diameter of the rolling bodies 2 is formed between the outer jacket surface and the inner jacket surface. The sleeve projection 3 and the sleeve projection 9 can thus be clamped by one or more of the rolling bodies 2. One opening element 8 each extends between the rolling bodies 2 arranged in pairs, and the opening elements are designed in the shape of fingers and are arranged on a ring. The ring is arranged rotatably on the pivot pin 5 and is coupled with the drive member 6 by a planet drive 7. A plurality of roller-type planet gears are arranged in respective recesses of the pivot pin 5, and their teeth engage the internal teeth of the drive member 6 at one end and the internal teeth of the ring of the opening elements 8 at their other end. Thus, rotation of the drive member 6 leads to rotation of the opening elements 8 engaging between the rolling bodies 2, so that these opening elements 8 are pressed out of their locked position and release a rotary movement between the sleeve projection 3 and the sleeve projection 9. The torque applied by the weight of the window shade on the outer sleeve 1 in the opposite direction leads to clamping of the sleeve projection 3 with the sleeve projection 9 by the rolling bodies 2 and consequently to locking of the outer sleeve 1 with the pivot pin 5. The outer sleeve 1 is nonrotatably inserted into the tubular end of a winding shaft 12 in the known manner.

The angle of rotation of the opening elements 8 is limited by the fact that the opening elements 8 have, on the inside, a coiled spring 10, (only partially shown in Figures) which extends in the axial direction and engages a substantially broader axial groove 11 on the outer jacket of the sleeve projection 3.

While a specific embodiment of the invention has been shown and described in detail to illustrate the application of the principles of the invention, it will be understood that the invention may be embodied otherwise without departing from such principles.

What is claimed:

1. Window shade, comprising:

a winding shaft;

a shaft sleeve projection rigidly mounted on the winding shaft, said shaft sleeve projection having an inner surface;

stationary pivots for rotatably mounting the winding shaft, one of said pivots being provided at each end of the winding shaft, a first pivot of said pivots having a pivot sleeve projection, a recess being defined between an inner jacket surface of said pivot sleeve projection and an outer jacket surface of said shaft sleeve projection, said recess being wedge-shaped in a circumferential direction;

opening element means arranged in said recess, said opening element means including an opening element;

a drive member coupled to said first pivot and engaged with said opening element for moving said opening element; locking member means for interlocking the winding shaft loaded in the roll-off direction of the window shade with said first pivot, to maintain the winding shaft stationary, said locking member means including at least one rolling body clamped in said recess, in a clamped position, said rolling member being released from the clamped position by movement of said opening element, by said drive member in the direction of rotation.

2. A window shade in accordance with claim 1, wherein said shaft sleeve projection, which is stationary in relation to the winding shaft, is rotatably mounted on said first pivot and has an outer jacket surface extending eccentrically in relation to a central axis.

3. A window shade in accordance with claim 2 wherein a plurality of recesses are provided in the circumferential direction between said shaft sleeve projection and said pivot sleeve projection, rolling bodies of said locking member means being arranged in pairs in each of said plurality of recesses.

4. A window shade in accordance with claim 1 wherein a plurality of recesses are provided in the circumferential direction between said shaft sleeve projection and said pivot sleeve projection, rolling bodies of said locking member means being arranged in pairs in each of said plurality of recesses.

5. A window shade in accordance with claim 1 wherein said opening element means includes opening elements extending in the axial direction between rolling bodies arranged in pairs, said opening elements being provided on a ring arranged rotatably on the first pivot, said ring being coupled with said drive member by a planet gear drive.

6. A window shade in accordance with claim 5, wherein said planet gears are arranged in recesses formed in said first pivot;

said drive member having inner teeth engaging said planet gears at one end of said planet gears;

said ring having inner teeth engaging another end of said planet gears.

7. A window shade in accordance with claim 1 further comprising: limit means for limiting the angle of rotation of said opening element means.

8. A window shade in accordance with claim 7, further comprising: an axially extending coil spring, said opening element means having an inside with said coil spring positioned therein, said coil spring engaging said opening element means to a broad groove on a circumference of said shaft sleeve projection.

9. A window shade in accordance with claim 1 wherein said shaft sleeve projection is provided at one end within an outer sleeve, which can be nonrotatably inserted into the open tubular end of said winding shaft, and is rotatably mounted on said pivot.

10. A window shade comprising:

a winding shaft:

a shaft sleeve projection rigidly mounted on said winding shaft;

stationary pivot means for rotatably mounting one end of said winding shaft, said stationary pivot means including a pivot sleeve projection, an inner surface of said pivot sleeve projection and an outer surface of said shaft sleeve projection defining a recess, said recess being wedge-shaped in a circumferential direction;

locking means positioned in said recess and for locking and unlocking said shaft sleeve projection and said pivot sleeve projection, said locking means including a rolling body movable in said recess into and out of a clamped position;

opening means positioned in said recess and for moving said rolling body out of said clamped position, said opening means including a plurality of opening elements movable into contact with said rolling body, said plurality of opening elements being connected by a ring;

a drive member coupled to said stationary pivot means and engaged with said opening element for moving said opening element;

a planet gear drive connecting said ring to said drive member.

11. A window shade in accordance with claim 10, wherein:

said planet gear drive includes a plurality of planet gears arranged in recesses formed in said stationary pivot means;

said drive member having inner teeth engaging one end of said planet gears;

said ring having inner teeth engaging another end of said planet gears.

12. A window shade comprising:

a winding shaft having an open tubular end;

an outer sleeve nonrotatably inserted into said open tubular end;

a shaft sleeve projection rigidly connected to said outer sleeve;

stationary pivot means for rotatably mounting said winding shaft, said stationary pivot means including a pivot sleeve projection, an inner surface of said pivot sleeve projection and an outer surface of said shaft sleeve projection defining a recess, said recess being wedge-shaped in a circumferential direction, said shaft sleeve projection being rotatably mounted on said stationary pivot means;

locking means positioned in said recess and for locking and unlocking said shaft sleeve projection and said pivot sleeve projection, said locking means including a rolling body movable in said recess into and out of a clamped position;

opening means positioned in said recess and for moving said rolling body out of said clamped position, said opening means including a plurality of opening elements movable into contact with said rolling body, said plurality of opening elements being connected by a ring;

a drive member coupled to said stationary pivot means and engaged with said opening element for moving said opening element.

* * * * *